United States Patent [19]

Röhm

[11] Patent Number: 4,616,383

[45] Date of Patent: Oct. 14, 1986

[54] BELT BUCKLE

[76] Inventor: Günter H. Röhm,
Heinrich-Röhm-Str. 50, 7927
Sontheim, Fed. Rep. of Germany

[21] Appl. No.: 790,964

[22] Filed: Oct. 24, 1985

[30] Foreign Application Priority Data

Oct. 25, 1984 [DE] Fed. Rep. of Germany ..... 3438996

[51] Int. Cl.[4] ..... A44B 11/25

[52] U.S. Cl. ..... 24/265 BC; 24/265 AL; 24/163 K; 24/182

[58] Field of Search ..... 24/265 BC, 265 AL, 163 K, 24/180, 182, 308, 573

[56] References Cited

U.S. PATENT DOCUMENTS

| | | | |
|---|---|---|---|
| 941,702 | 11/1909 | Fishel | 24/163 K |
| 2,913,794 | 11/1959 | Ostrower | 24/163 K |
| 3,908,239 | 9/1975 | Gorman | 24/163 K |
| 4,260,087 | 4/1981 | Leaver | 24/163 K |
| 4,318,207 | 3/1982 | Stroud | 24/265 BC |
| 4,377,939 | 3/1983 | Reinsdorf | 24/163 K |

*Primary Examiner*—Victor N. Sakran
*Attorney, Agent, or Firm*—Karl F. Ross; Herbert Dubno

[57] ABSTRACT

A belt buckle plate having a rear face formed with a pair of axis-defining pivots one of which is a radially closed eye and the other of which has a radially open slot. A loop adapted to engage through the end of a belt has a short pintle and a long pintle extending in the same direction from the loop in line with one another. The short pintle normally extends on the axis through the eye pivot and the long pintle normally extends in a fully engaged position on the axis through and at least a predetermined axial distance in one axial direction past the slotted pivot. A retainer formation is provided on the rear face spaced axially less than the predetermined distance in the one direction from the slotted pivot and normally bearing radially on the long pintle in the fully engaged position thereof to hold it in the slotted pivot. A radial projection is provided on the long pintle axially offset in the one axial direction in the fully engaged position thereof from the slotted pivot by the predetermined distance. An abutment on the buckle plate offset axially from the slotted pivot generally by the predetermined distance is engageable axially with the slotted pivot except when the loop is generally in the opposite end position in which case the abutment and projection are axially out of line and the projection can move axially past the abutment.

7 Claims, 4 Drawing Figures

BELT BUCKLE

FIELD OF THE INVENTION

The present invention relates to a belt buckle. More particularly this invention concerns a pistol buckle of the type described in my copending patent application Ser. No. 790,858 filed Oct. 24, 1985.

BACKGROUND OF THE INVENTION

A standard belt buckle is carried on one end of a belt and is constituted to grip or hold the other end of the same belt. The free end of the belt may be clamped or gripped, or it may be provided with a row of holes into which a gripper tooth or tongue on the buckle can engage. The belt end the buckle is attached to is usually provided with a throughgoing pocket through which a loop or bar on the buckle engages. When this pocket is permanently made in the belt, the buckle loop or bar must be openable; when the pocket can be opened the loop or bar can be fixed on the buckle.

The standard such system has a C-shaped loop having a central bight that engages through the belt pocket and a pair of coaxial feet that pass through eyes on the buckle and that are headed like rivets between these eyes to hold the loop in place. Such construction is fairly complex because it requires the use of machine tools to assemble the buckle, so it adds to the cost of the buckle. Furthermore, a buckle so made cannot be used with a belt having a permanent loop.

OBJECTS OF THE INVENTION

It is therefore an object of the present invention to provide an improved belt buckle.

Another object is the provision of such a belt buckle which overcomes the above-given disadvantages, that is which is of simple construction, which is easy to assemble and disassemble, and which can be used with a belt with a permanent closed pocket.

Yet another object is to provide a belt buckle to which a small pistol can be fitted as described in my jointly filed and copending application Ser. No. 790,858 filed Oct. 24, 1985.

SUMMARY OF THE INVENTION

A belt buckle according to the invention has a generally planar buckle plate having a rear face formed with a pair of pivots defining and spaced apart along an axis extending generally parallel to the plane of the buckle. One of the pivots is formed as a radially closed eye open only axially and the other pivot is open axially and is also formed with a slot open in a radial direction generally parallel to the plane. A loop adapted to engage through the end of a belt has a short pintle and a long pintle extending in the same direction from the loop in line with one another. The short pintle normally extends on the axis through the eye pivot and the long pintle normally extends in a fully engaged position on the axis through the slotted pivot and at least a predetermined axial distance in one axial direction past the slotted pivot. The slot is wider than the long pintle and the loop is movable angularly in the pivots between a normal end position and an opposite end position angularly offset therefrom. A retainer formation is provided on the rear face spaced axially less than the predetermined distance in the one direction from the slotted pivot and spaced in the radial direction from the slotted eye. The long pintle in the fully engaged position normally engages the retainer formation in the radial direction, so that this retainer formation normally prevents the long pintle from moving in the radial direction out of the slotted eye through the slot thereof. A radial projection is provided on the long pintle axially offset in the one axial direction in the fully engaged position thereof from the slotted pivot by the predetermined distance. An abutment on the buckle plate offset axially from the slotted pivot generally by the predetermined distance is engageable axially with the slotted pivot in an axial direction opposite the one direction except when the loop is generally in the opposite end position in which case the abutment and projection are axially out of line and the projection can move axially past the abutment.

Such an arrangement is extremely simple, as the buckle plate can be unitarily formed with the pivots, retainer formation, and abutment, and the loop can be unitarily formed with the pintles and projection. In normal use the loop is prevented from moving axially in the pivots by the abutment and from moving radially out of the slotted pivot by the retainer formation. When the loop is pivoted around it can be slid axially and then displaced radially to remove it. This latter position, however, cannot be assumed by the parts when the belt is being worn and in fact is not assumed during normal handling of the belt.

The loop can be threaded easily through a preformed pocket of a belt, and the buckle can even be moved readily between different belts. Furthermore, the buckle can be assembled without the use of machine tools for bending and riveting, that is wholly by hand, so that manufacturing costs are very low.

According to a feature of this invention the end positions of the loop are generally 180° offset from each other and the loop extends generally parallel to the plane in both end positions. Furthermore the abutment is in part a shoulder formed on the buckle plate and the retainer formation has a surface contiguous with the shoulder and also forming a part of the abutment. To facilitate assembly and disassembly the predetermined distance is at least equal to the axial dimension of the projection. Furthermore for lowest manufacturing costs the pintles are on the ends of the loop and the projection is on the end of the long pintle and the loop, pintles, and projection are all of the same section. Thus the loop, pintles, and projection can all be formed of a single thick wire.

DESCRIPTION OF THE DRAWING

The above and other features and advantages will become more readily apparent from the following, reference being made to the accompanying drawing in which.

SPECIFIC DESCRIPTION

Figure 2:
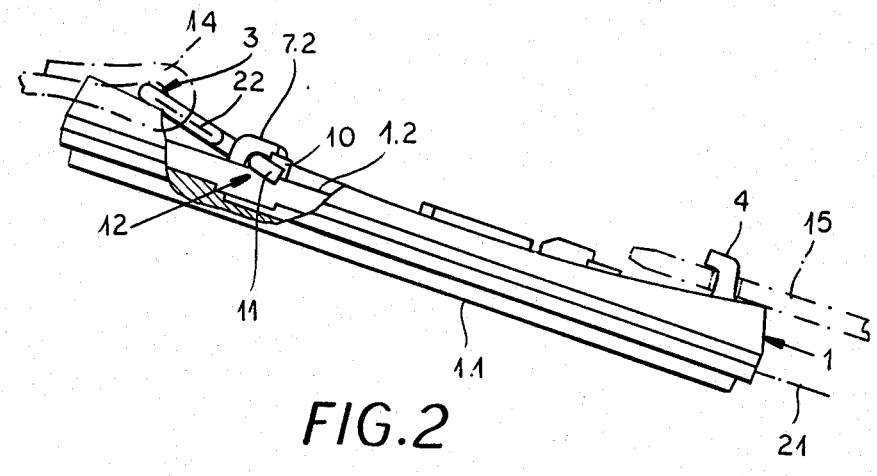
FIGS. 2 and 3 are partly sectional edge views taken in the direction of respective arrows II and III of FIG. 1.

As seen in the drawing the buckle according to this invention basically comprises a buckle plate 1 lying in and defining a plane 21 and having a front face 1.1 and an opposite rear face 1.2. As shown only in FIG. 1 a loop indicated generally at 3 is adapted to fit through the pocket at one end 14 of a belt, and the opposite end of the generally elongated buckle plate 1 is provided with a gripper hook 4 adapted to engage through the opposite belt end 15. The front face 1.1 is formed with a pistol-shaped recess or seat 19 and is provided with a latch mechanism 18 as described in my above-mentioned patent application for a pistol of the type described in my jointly filed and copending application Ser. No. 792,763, filed Oct. 30, 1985.

The rear face 1.2 of the plate 1 is formed unitarily with two pivots 7.1 and 7.2 defining coaxial seats 6.1 and 6.2 centered on an axis 2 parallel to the plane 21. The pivot 7.1 and seat 6.1 are formed as an eye that is open only axially. The pivot 7.2 and seat 6.2 are formed with a slot 8 open in a direction 20 which here is parallel to the plane 21 and toward the hook 4 at the opposite end of the plate 1. In fact the direction 20 need merely be at least 90° offset from the direction in which the belt end 14 will pull on the loop 3 when the belt is worn, which direction is here illustrated at 9.

The loop 3 has a straight bight portion 3.1 fitting through the belt end 14 and a pair of parallel legs 3.2 extending at right angles from the bight 3.1. A short pintle 5.1 extends parallel to the bight 3.1 from the end of one of the legs 3.2 toward the other leg 3.2, and this other leg 3.2 has a connecting portion 3.3 extending oppositely back and provided with an elbow 3.4 from which a long pintle 5.2 extends in line and in the same direction as this pintle 5.1. The pintles 5.1 and 5.2 are unitarily formed with the bight 3.1, legs 3.2, portion 3.3, and elbow 3.4 of a wire of constant circular section that corresponds to the inside diameter of the seats 6.1 and 6.2 and the width of the slot 8.

Figure 1:
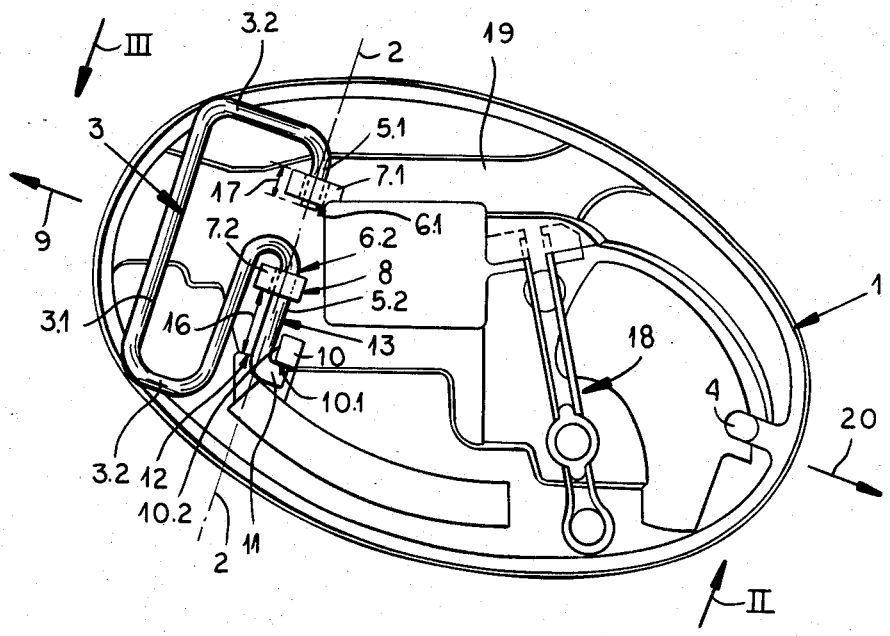
FIG. 1 is a back view of the buckle according to this invention in the normal or closed position.
Figure 3:
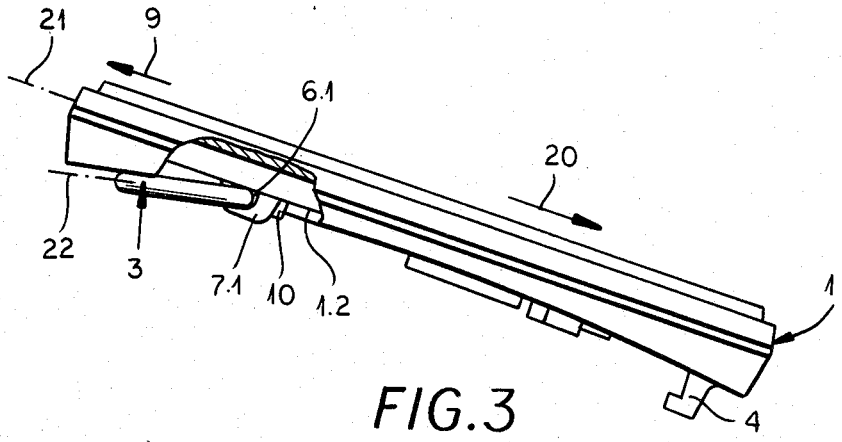

During normal use as shown in FIGS. 1, 2, and 3 the loop 3, which defines its own plane 22, extends mainly in the direction 9 opposite the direction 20 from the axis 2. The rear face 1.2 is formed with a retaining bump 10 projecting back from the plane 21 at a location spaced axially by a gap 13 from the pivot 7.2 and having a face 10.2 directed at the axis 2 and spaced therefrom by a distance slightly greater than the radius of the wire forming the loop 3 and pintles 5.1 and 5.2. The long pintle 5.2 extends axially past this bump 10 by an axial distance 16, so that when in the FIG. 1 position this bump 10 prevents the pintle 5.2 from being pushed in the direction 20 from the pivot 7.2 through the slot 8. Thus this bump 10 effectively closes this slot 8 when the pintle is fully inserted in the position of FIGS. 1 through 3.

In addition the free end of the long pintle 5.2 is formed with a lateral projection 11 extending perpendicular from the pintle 5.2 in the plane 22 away from the bight 3.1. This projection 10 engages around an axial end surface 10.1 of the bump 10, preventing the loop 3 from moving axially up as seen in FIG. 1 in the position of FIGS. 1 through 3. Thus under normal circumstances the loop 3 is effectively fixed axially on the plate 1. In addition the recess 19 of the buckle plate 1 defines an abutment shoulder 12 coplanar with the surface 10.1 so that even if the loop 3 pivots clockwise as shown in FIG. 2 through about 160° the projection 11 will remain axially aligned with this shoulder 12 and the loop 3 will be unable to move axially in the pivots 7.1 and 7.2.

Figure 4:
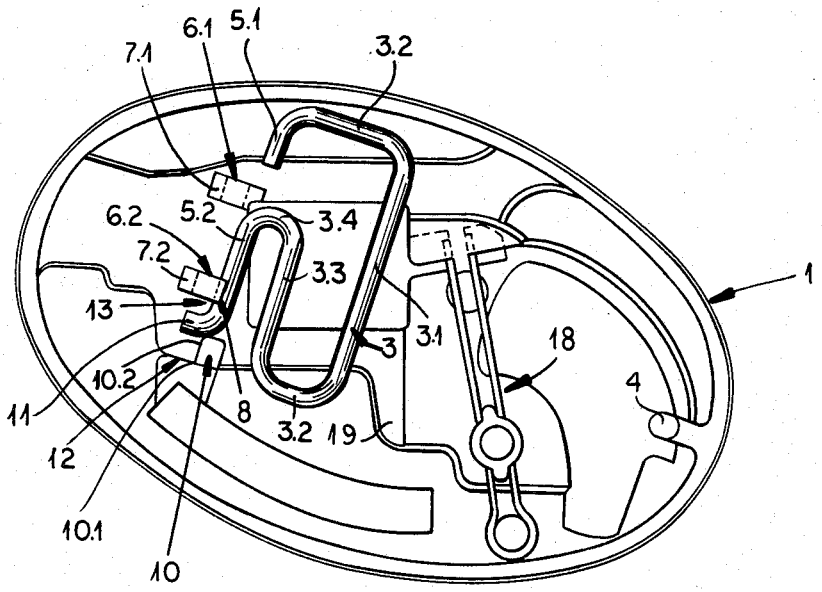
FIG. 4 is a back view of the buckle according to this invention in the open position.

When, however, the loop 3 pivots from this normal position through about 180° so the plane 22 extends in the direction 20 from the axis 2 the projection 11 will pass the abutment surface 12 formed by the seat 19 whereupon as seen in FIG. 4 it is possible to slide the loop 3 axially until the pintle 5.1 pulls out of the pivot 7.1 and the projection 11 of the pintle 5.2 moves past the retainer 10. In this position the pintle 5.2 can be pulled radially in the direction 20 out of the slot 8. This completely frees the loop 3 from the plate 1 so it can be threaded through the belt end 14. To achieve this purpose the axial length 16 is greater than the axial depth 17 that the pintle 5.1 projects into and past the pivot 7.1. Thus the pintle 5.1 will disengage from the pivot 7.1 before the projection 11 engages the pivot 7.2, making it possible to move the loop 3 in the direction 20.

Thus with the system of this invention the loop 3 can be removed from the buckle plate 1 by pivoting it over into the FIG. 4 position, then sliding it axially up until the projection 11 engages the pivot 7.2, and then pulling it in the direction 20 out of the slotted pivot 7.2. During normal use, however, the abutments 10 and 12 and surface 10.1 together effectively prevent any displacement of the loop 3 either parallel to or radially of the axis 2, while permitting substantial pivoting about the axis 2 without disconnection. The plate 1 can be a simple part cast with no subsequent machining, and the loop 3 can be an inexpensive bent piece of wire, and this loop 3 can be mounted on the buckle plate 1 by hand, without using any tools.

I claim:

1. A belt buckle comprising:

a generally planar buckle plate having a rear face;

a pair of pivots on the rear face defining and spaced apart along an axis extending generally parallel to the plane of the buckle, one of the pivots being formed as a radially closed eye open only axially and the other pivot being open axially and also being formed with a slot open in a radial direction generally parallel to the plane;

a loop adapted to engage through the end of a belt;

a short pintle and a long pintle extending in the same direction from the loop in line with one another, the short pintle normally extending on the axis through the eye pivot and the long pintle normally extending in a fully engaged position on the axis through the slotted pivot and at least a predetermined axial distance in one axial direction past the slotted pivot, the slot being wider than the long pintle, the loop being movable angularly in the pivots between a normal end position and an opposite end position angularly offset therefrom;

a retainer formation on the rear face spaced axially less than the predetermined distance in the one direction from the slotted pivot and spaced in the radial direction from the slotted eye, the long pintle in the fully engaged position normally engaging the retainer formation in the radial direction, whereby the retainer formation normally prevents the long pintle from moving in the radial direction out of the slotted eye through the slot thereof;

a radial projection on the long pintle axially offset in the one axial direction in the fully engaged position thereof from the slotted pivot by the predetermined distance; and an abutment on the buckle plate offset axially from the slotted pivot generally by the predetermined distance and engageable axially with the slotted pivot in an axial direction opposite the one direction except when the loop is generally in the opposite end position in which case the abutment and projection are axially out of line and the projection can move axially past the abutment.

2. The belt buckle defined in claim 1 wherein the end positions of the loop are generally 180° offset from each other.

3. The belt buckle defined in claim 2 wherein the loop extends generally parallel to the plane in both end positions.

4. The belt buckle defined in claim 1 wherein the abutment is in part a shoulder formed on the buckle plate and the retainer formation has a surface contiguous with the shoulder and also forming a part of the abutment.

5. The belt buckle defined in claim 1 wherein the predetermined distance is at least equal to the axial dimension of the projection.

6. The belt buckle defined in claim 1 wherein the pintles are on the ends of the loop and the projection is on the end of the long pintle and the loop, pintles, and projection are all of the same section.

7. A belt buckle comprising:

a generally planar buckle plate having a rear face in turn having one end provided with a belt gripper and an opposite end;

a pair of pivots on the opposite end of the rear face defining and spaced apart in one axial direction along an axis extending generally parallel to the plane of the buckle, one of the pivots being formed as a radially closed eye open only axially and the other pivot being open axially and also being formed with a slot open in a radial direction generally parallel to the plane and toward the one end thereof;

a retainer formation on the rear face spaced axially less than the predetermined distance in the one direction from the slotted pivot and spaced in the radial direction from the slotted eye toward the one end;

a loop having a bight adapted to engage through the end of a belt, a pair of spaced and parallel legs extending from the bight, a short pintle normally extending in the one direction on the axis through the eye pivot, and a long pintle extending in the one direction in line with the short pintle and normally extending in a fully engaged position on the axis through the slotted pivot and at least a predetermined axial distance in the one axial direction past the slotted pivot, the slot being wider than the long pintle, the loop being movable angularly in the pivots through about 180° between a normal end position generally parallel to the plane and with the axis between the bight and the one end and an opposite end position also generally parallel to the plane but with the bight between the axis and the one end, the long pintle in the fully engaged position normally engaging the retainer formation in the radial direction, whereby the retainer formation normally prevents the long pintle from moving in the radial direction out of the slotted eye through the slot thereof;

a radial projection on the long pintle axially offset in the one axial direction in the fully engaged position thereof from the slotted pivot by the predetermined distance; and an abutment on the buckle plate offset axially from the slotted pivot generally by the predetermined distance and engageable axially with the slotted pivot in an axial direction opposite the one direction except when the loop is generally in the opposite end position in which case the abutment and projection are axially out of line and the projection can move axially past the abutment.

* * * * *